US005645255A

United States Patent [19]

Parduhn

[11] Patent Number: 5,645,255

[45] Date of Patent: Jul. 8, 1997

[54] ARTICULATING CLAMP ASSEMBLY FOR TRAFFIC CONTROL DEVICE

[75] Inventor: Stephen P. Parduhn, Edmond, Okla.

[73] Assignee: Pelco Products, Inc., Edmond, Okla.

[21] Appl. No.: 455,921

[22] Filed: May 31, 1995

[51] Int. Cl.[6] ..... A47B 96/06

[52] U.S. Cl. ..... 248/214; 248/292.12; 248/230.1; 403/97

[58] Field of Search ..... 248/214, 219.4, 248/218.4, 292.12, 230.1, 278.1; 403/97, 256, 261, 388, 396

[56] References Cited

U.S. PATENT DOCUMENTS

| | | | |
|---|---|---|---|
| 3,888,446 | 6/1975 | O'Brien et al. . | |
| 4,101,191 | 7/1978 | Gould et al. . | |
| 4,142,173 | 2/1979 | Gould et al. . | |
| 4,460,142 | 7/1984 | O'Rorke | 248/214 X |
| 4,489,910 | 12/1984 | Ferguson . | |
| 4,659,046 | 4/1987 | Parduhn . | |
| 4,860,985 | 8/1989 | Olson et al. . | |
| 4,917,338 | 4/1990 | Olson et al. . | |
| 5,069,416 | 12/1991 | Ennis | 248/292.12 X |
| 5,105,350 | 4/1992 | Tolman et al. . | |
| 5,299,773 | 4/1994 | Bertrand | 248/292.12 X |
| 5,340,069 | 8/1994 | Niemeyer | 248/214 |

OTHER PUBLICATIONS

Publication of Kentron, Inc. entitled "Adjustable Mast Arm Hanger," published in U.S. at least as early as May 1, 1994.

*Primary Examiner*—Wynn E. Wood
*Assistant Examiner*—Timothy B. Kang
*Attorney, Agent, or Firm*—McKinney, Stringer & Webster, P.C.

[57] ABSTRACT

An articulating clamp assembly for attaching a traffic control device to a mast arm upright pole or other support member. The clamp assembly includes a saddle clamp which adjustably attaches to the vertical elongate member on the bracket of a traffic signal. Either a cable clamp or a tenon clamp can be included for attaching the assembly to the mast arm or pole. The cable clamp includes inner and outer tubular members which are rotatable relative to each other, and of course the anchor plate of the cable clamp can be positioned anywhere along the length of the mast arm or pole and anywhere around the circumference. Similarly, the tubular end of the tenon clamp can rotated relative to the mast arm for proper positioning. The mast arm clamp and the saddle clamp are joined by a pair of serrated rings which permit a wide range of rotational adjustment between the two clamp members. Thus, the articulating clamp assembly of the present invention permits multiple adjustments. Moreover, the clamp members include an inner channel which is continuous through the entire assembly. This permits the wiring to be threaded inside the clamp assembly.

14 Claims, 11 Drawing Sheets

ARTICULATING CLAMP ASSEMBLY FOR TRAFFIC CONTROL DEVICE

FIELD OF THE INVENTION

The present invention relates generally to clamp assemblies for supporting traffic control devices on mast arms or other support members.

SUMMARY OF THE INVENTION

The present invention is directed to a clamp assembly for supporting a traffic control device on an elongate support member. In one embodiment, the clamp assembly comprises a first clamp having a first end and a second end. The first clamp also has an opening in the first end, an opening in the second end, and an internal channel connecting the openings in the first and second ends. Also included is a connecting assembly on the first end of the first clamp adapted to removably attach the first end of the first clamp member to the traffic control device.

The clamp assembly further comprises a second clamp having a first end, and a second end. There is an opening in the first end, an opening in the second end, and an internal channel connecting the openings in the first and second ends. Further, the first end is rotatable on the longitudinal axis relative to the second end. A connecting assembly is provided on the first end of the second clamp to removably attach the first end of the second clamp to the elongate support member so that the second clamp extends generally perpendicular to the elongate support member and so that the second clamp can be attached to the elongate support member in a plurality of positions along the length of the support member and in a plurality of positions about the circumference of the support member.

Still further, the clamp assembly includes a first serrated ring on the second end of the first clamp and a second serrated ring on the second end of the second clamp. The second serrated ring is adapted to removably mate with the first serrated ring in a plurality of selected positions, and so that the openings in the second ends of the first and second clamps are aligned so as to connect the internal channels when the first and second serrated rings are interengaged. A connector assembly is included for rigidly connecting the second end of the first clamp to the second end of the second clamp when the first and second serrated rings are interengaged in a selected position.

In another embodiment, the present invention is directed to a clamp assembly for supporting a traffic control device on an elongate support member wherein the traffic control device comprises a bracket having an elongate member. In this embodiment, the clamp assembly comprises a first clamp having a first end and a second end and a longitudinal axis. There is an opening in the first end, an opening in the second end, and an internal channel connecting the openings in the first and second ends. A connecting assembly is provided on the first end of the first clamp, and it is adapted to removably attach the first end of the first clamp member to the traffic control device so that the first clamp is perpendicular to the elongate member of the bracket of the traffic control device and so that the first clamp can be attached in a plurality of positions along the length of the elongate member and in a plurality of positions about the circumference of the elongate member.

The clamp assembly further comprises a second clamp also having a first end and a second end. This second clamp also has an opening in the first end, an opening in the second end, and an internal channel connecting the openings in the first and second ends. Still further, a connecting assembly is provided on the first end of the second clamp. The connecting assembly is adapted to removably attach the first end of the second clamp to the end of the elongate support member so that the second clamp and the support member are axially aligned.

There is a first serrated ring on the second end of the first clamp and a second serrated ring on the second end of the second clamp. The second serrated ring is adapted to removably mate with the first serrated ring in a plurality of selected positions, and so that the openings in the second ends of the first and second clamps are aligned so as to connect the internal channels when the first and second serrated rings are interengaged. A connector assembly is included for rigidly connecting the second end of the first clamp to the second end of the second clamp when the first and second serrated rings are interengaged in a selected position.

DETAILED DESCRIPTION OF THE PREFERRED EMBODIMENT

A variety of devices currently are employed to control vehicular traffic on heavily traveled roadways. These devices include traffic signals for directing the flow of traffic at intersections, as well as sign, warning lights, monitoring devices and counting devices. As used herein, "traffic control devices" is intended to include any such devices. Because of the diversity in the configurations of traffic intersections and other sites where traffic control devices are required, as well as the variety of types of supporting structures available at such locations, there is a need for versatility in the mechanisms which attach the traffic control devices to the support structures.

The clamp assembly of the present invention is comprised of several articulating elements which provides adjustability at several points in the assembly. Thus, the clap assembly is well suited for use with a variety of supporting structures and traffic control devices. The clamp assembly includes two clamps—one which attaches to the control device and one which attaches to the support structure. In addition to the multiple adjustment points, the clamp assembly is designed to permit the wiring for the traffic control device to be threaded internally through the clamp assembly. These and other advantages of the present invention will be apparent from the following description of the preferred embodiments and the accompanying drawings.

Figure 1:
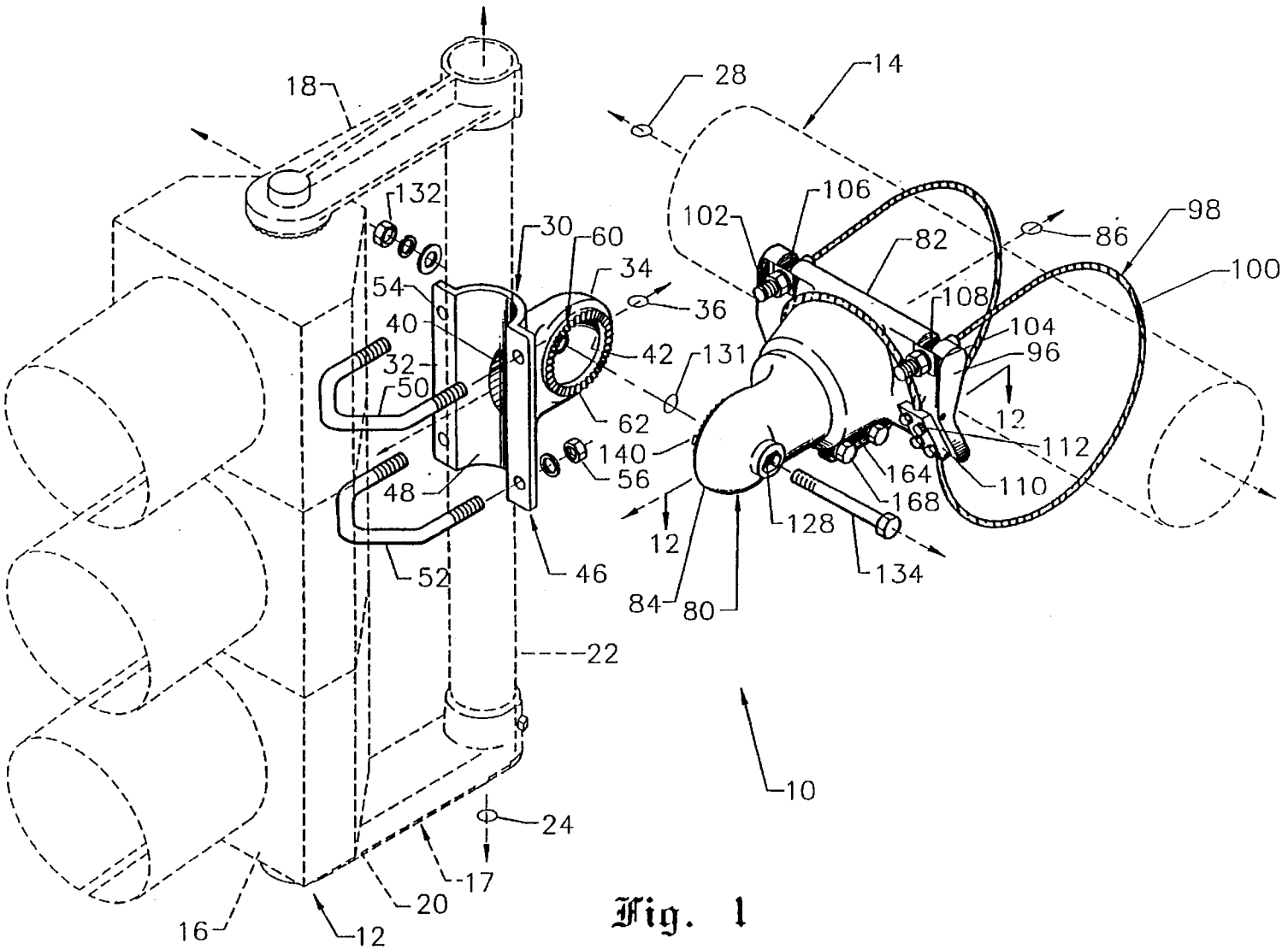
FIG. 1 is a right frontal perspective view of a first embodiment of a clamp assembly constructed in accordance with the present invention. In this embodiment, the clamp assembly comprises a cable clamp which supports the bracket of the traffic signal on the side of a mast arm. The mast arm, bracket and signal are shown in phantom to better illustrate the structure of the clamp assembly.
Figure 3:
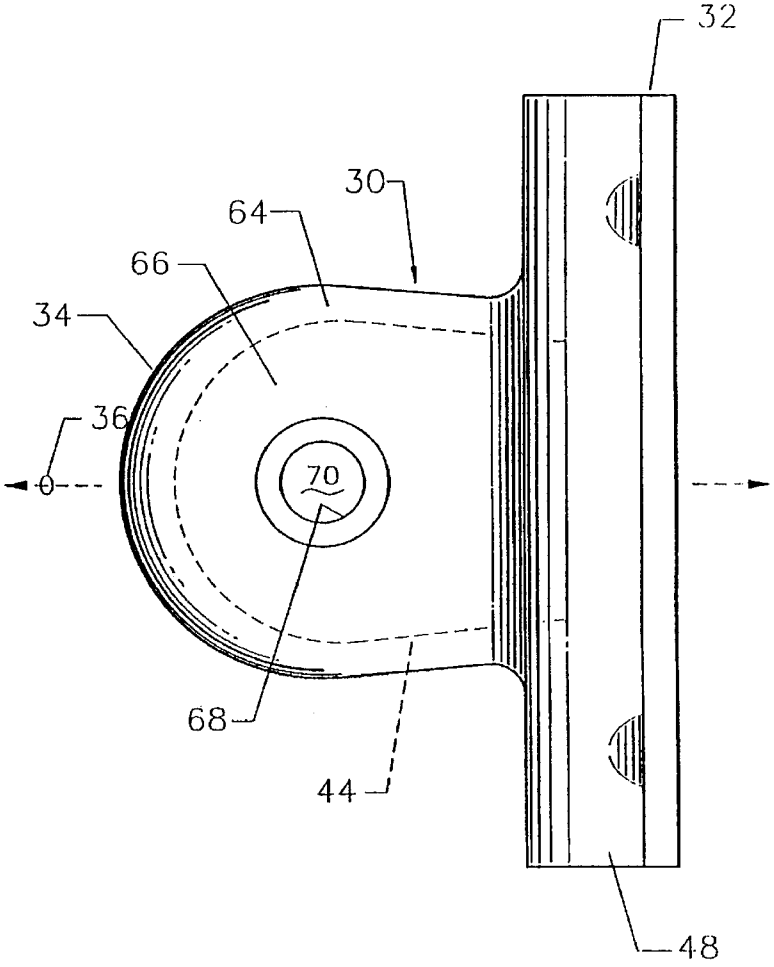
FIG. 3 is a rear elevational view of the first clamp.
Figure 2:
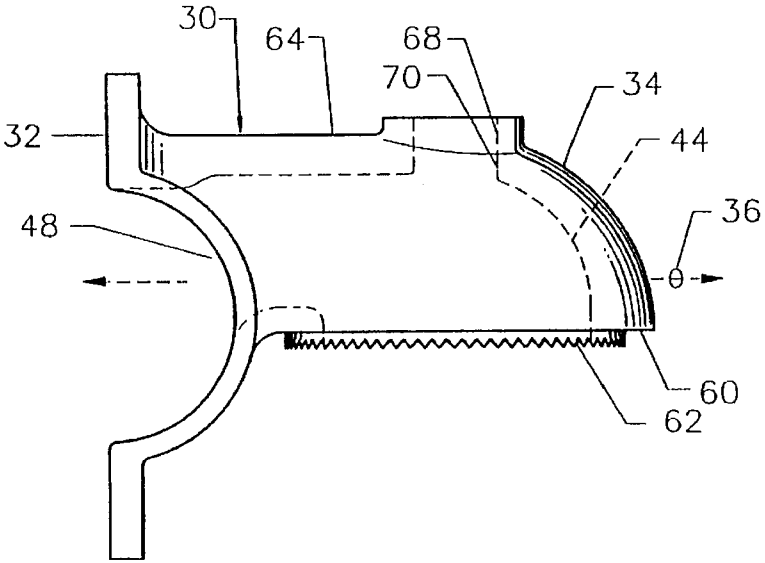
FIG. 2 is a plan view of the first clamp.
Figure 5:
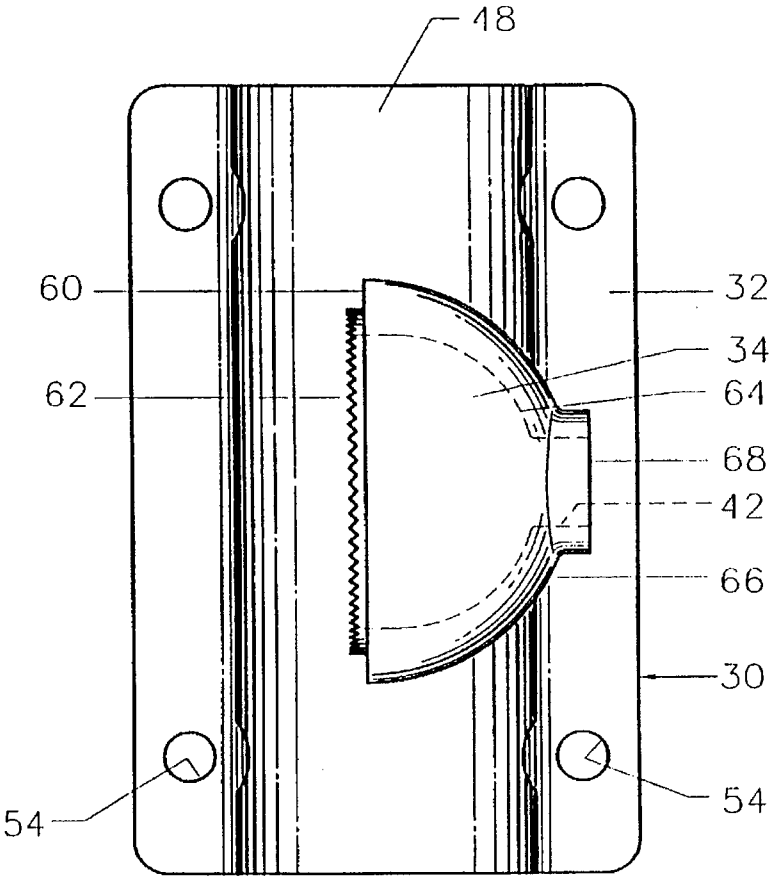
FIG. 5 is an elevational view of the other end of the first clamp.
Figure 4:
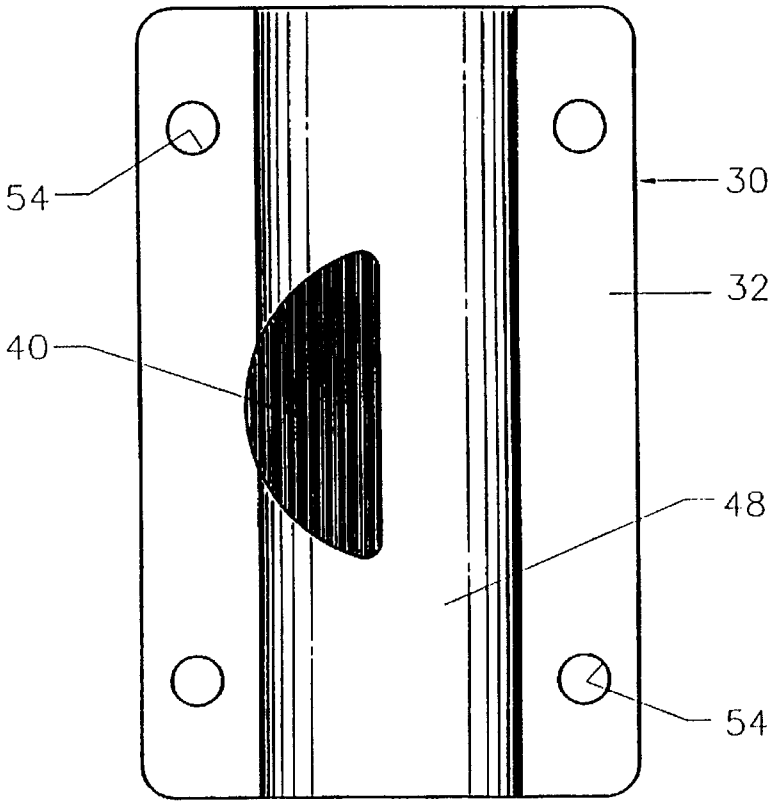
FIG. 4 is an elevational view of the end of the first clamp that attaches to the traffic signal bracket.
Figure 6:
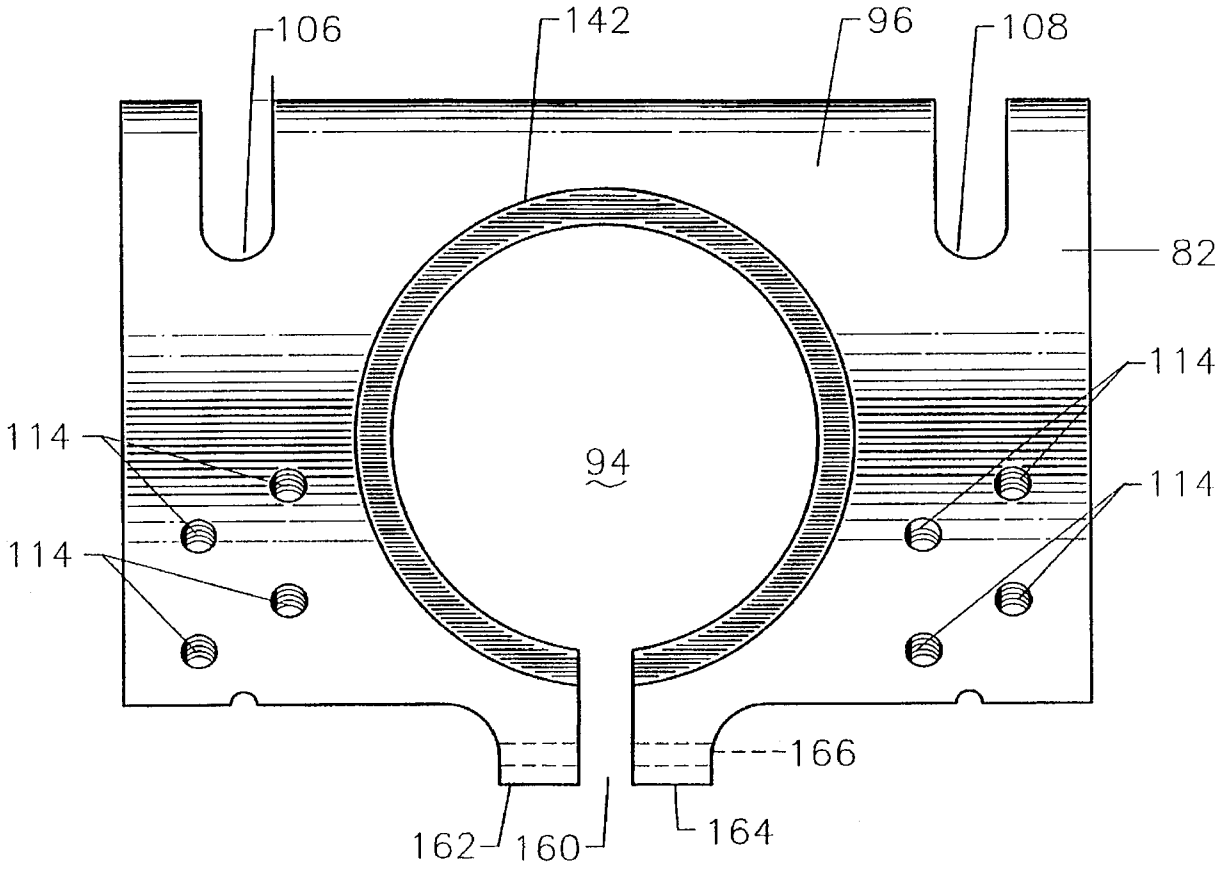
FIG. 6 is an elevational view of the first end of the first end member of the second clamp.

With reference now to the drawings in general and to FIG. 1 in particular, there is shown therein a first embodiment of the present invention. The clamp assembly, designated generally by the reference numeral 10, is shown supporting a conventional three section traffic signal 12 from a mast arm 14. The traffic signal 12 is of a typical design including a signal body 16 rotatably supported (See also FIG. 12) on a bracket 17 which includes upper and lower arms 18 and 20 extending horizontally from an elongate member 22, the elongate member having a longitudinal axis indicated at 24. It will appreciated, though, that the clamp assembly 10 is suitable for use with many other types and configurations of traffic control devices.

The mast arm 14 is an elongate support member which has a longitudinal axis indicated at 28 and typically extends generally horizontally from a vertical pole or post of some sort (not shown). However, it will be understood that the clamp assembly 10 can be used to mount the signal 12 or other traffic control device on other types of elongate support members such as cables.

With continuing reference to FIG. 1 and referring now also to FIGS. 2–5, the clamp assembly 10 comprises a first clamp 30. As used herein, "clamp" means any device for connecting two devices together and is not limited to the clamp configuration shown and described herein. The first clamp 30 has a first end 32 and a second end 34 and a longitudinal axis at 36. An opening 40 is provided in the first end 32 (FIG. 4), and an opening 42 is provided in the second end 34. An internal channel 44 is formed through the body of the first clamp to connect the openings 40 and 42 in the first and second ends 32 and 34.

The first end 32 is adapted to removably attach the clamp to the traffic control device. To that end, the first end 32 is provided with a clamp assembly 46. Of course the configuration of the clamp assembly will vary depending upon the structure of the control device. In this embodiment, the clamp assembly 46 comprises a saddle 48 formed on the first end 32 shaped to conform to the elongate member 22 of the bracket 17 of the signal 12. For securing the saddle 48 to the elongate member 22, the clamp assembly 46 includes a pair of U-bolts 50 and 52 receivable in bolt holes 54. Nuts 56 are included to fix the bolts 50 and 52 in the holes 54. In this way, the longitudinal axis 36 of the first clamp 30 is perpendicular to the longitudinal axis 24 of the elongate member 22 of the signal bracket 17.

Thus, the clamp assembly 46 allows the first clamp 30 to be removably attached to the elongate member 22 anywhere along its length. Similarly, the clamp assembly 46 allows the first clamp to be rotated around the circumference of the elongate member 22, except of course for the area blocked by the signal body 16 itself. This permits the signal 12 to be turned in a wide range of directions and also to be adjusted vertically, simply by positioning the first end 32 of the first clamp 30 in the desired location on the elongate member 22.

Referring still to FIGS. 1–5, the second end 34 of the first clamp 30 defines a face 60 through which the opening 42 extends. Surrounding the opening 42, the face 60 includes a ring 62 with radial serrations. The plane formed by the serrated ring 62 preferably is parallel to the longitudinal axis 36 of the first clamp 30. For a purpose yet to be described, the first clamp 30 includes a body portion 64 (FIGS. 2, 3 and 5) which connects the first and second ends 32 and 34 and forms a wall 66 opposite the serrated ring 62. A bolt hole 68 is formed in the wall 66 and with the internal channel 44 forming a bore 70 through the body 66 for a connector assembly described hereafter.

Referring still to FIG. 1 and turning now also to FIGS. 6–12, the clamp assembly 10 further comprises a second clamp 80. The second clamp 80 has a first end 82, a second end 84 and a longitudinal axis indicated at 86. The first end 82 has an opening 90 and the second end 84 has an opening 92, and the openings 90 and 92 are connected by an internal channel 94 extending through the second clamp 80.

Figure 12:
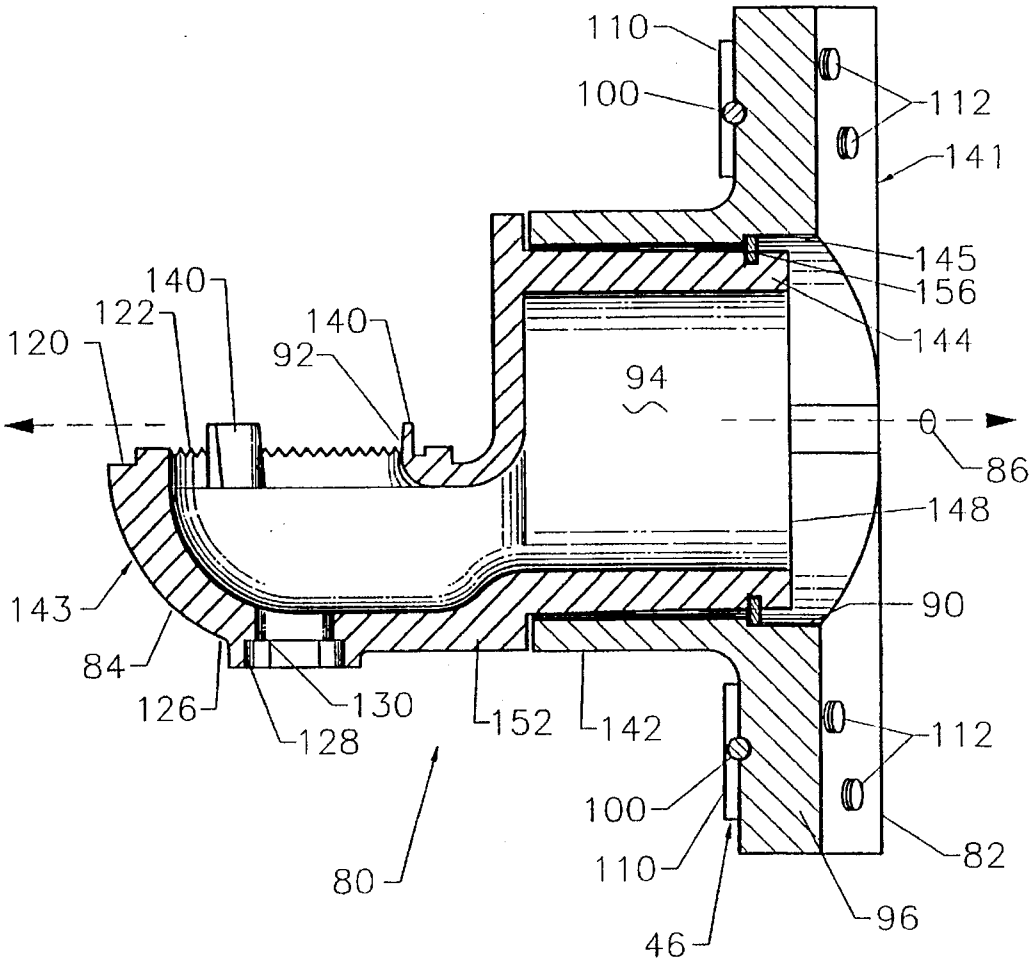
FIG. 12 is a longitudinal sectional view taken along line 12—12 of FIG. 1.

The first end 82 includes an anchor plate 96 (FIG. 1, 6–8, 12) which is shaped to permit the anchor plate to be attached to the mast arm 14 as shown in FIG. 1. As shown in the drawings, the profile of the anchor plate 96 is a wide "V." This allows the anchor plate to be attached to mast arms of different diameters. A connector assembly 98 is included for removably attaching the anchor plate 96 to the mast arm 14 so that the second clamp 80 extends generally perpendicular to the longitudinal axis 28 of the mast arm. Although the connector assembly 98 may take several forms, a preferred assembly comprises a flexible cable 100 (FIGS. 1 and 12). The cable 100 is provided with bolted ends 102 and 104, the bolts being receivable in notches 106 and 108 on the upper edge of the anchor plate 96. The center of the cable 100 is wrapped around the top of the second clamp 80, and the ends 102 and 104 are brought down on the sides, then up around the mast arm and then tightened in the notches 106 and 108. Cable plates 110 are provided on each side of the anchor plate 96 for securing the position of the cable on the plate. The cable plates 110 are secured by bolts 112 received in holes 114 on the anchor plate. This connector assembly 98 allows the second clamp 80 and thus the signal 12 to be attached anywhere along the length of the mast arm 14, and also anywhere around the circumference of the mast arm.

Figure 9:
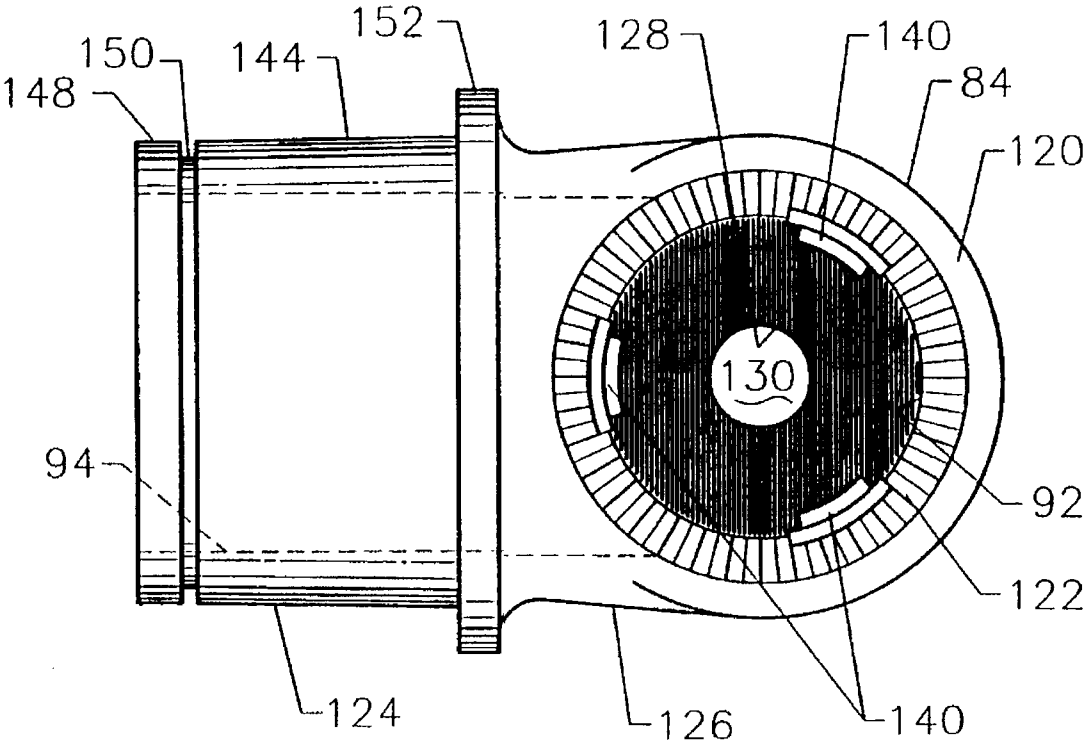
FIG. 9 is a side elevational view of the second end member of the second clamp.
Figure 11:
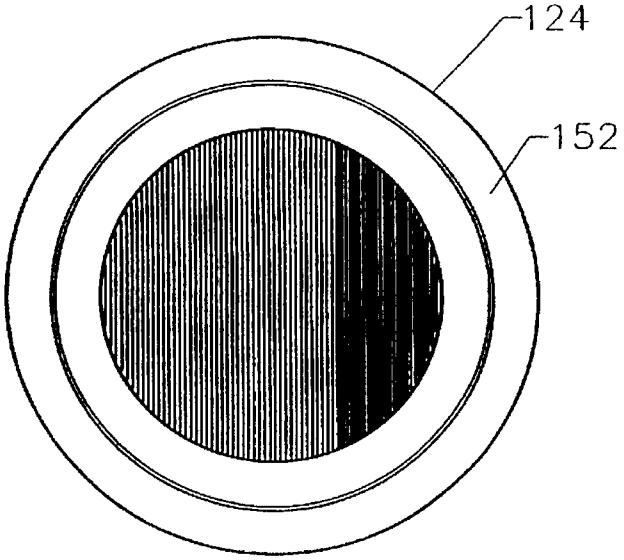
FIG. 11 is an elevational view of the second end of the second end member of the second clamp.
Figure 10:
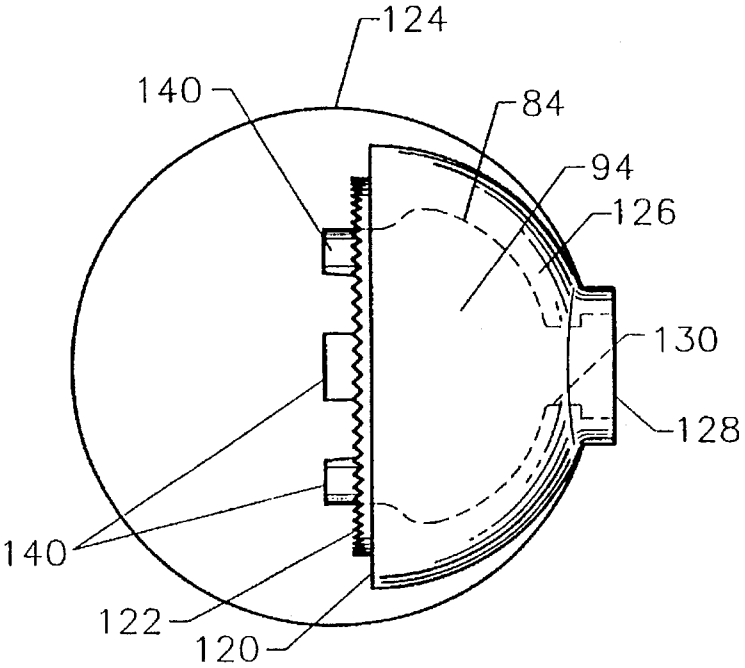
FIG. 10 is an elevational view of the second end of the second end member of the second clamp.

As best shown in FIGS. 9, 10 and 12, the second end 84 of the second clamp 80 forms a face 120 through which the opening 92 extends. Surrounding the opening 92, the face 120 includes a ring 122 with radial serrations. The wall 126 opposite the serrated ring 122 forms a bolt hole 128 continuous with the internal channel 94 forming a bore 130 (FIG. 9 and 12). The serrated ring 122 is shaped to removably mate with the serrated ring 62 on the second end 34 of the first clamp 30 and so that the internal channels 94 and 44 are aligned forming a continuous channel from the first end 32 of the first clamp 30 to the first end 82 of the second clamp. The face 120 defines a plane parallel to the longitudinal axis 86 of the second clamp 80. In this way, the rotational position of ring 62 relative to the ring 122 can be adjusted. Thus, the first clamp 30 and the second clamp 80 are pivotally adjustable relative to each other about the axis 131.

As shown in FIG. 1, a connector assembly is provided to rigidly connect the second end 84 of the second clamp 80 to the second end 34 of the first clamp 30, once the rings 62 and 122 have been matingly engaged in the selected position. A suitable connector assembly is a simple nut 132 and bolt 134 connector, the bolt sized to extend through the holes 128 and 68 and the bores 130 and 70.

To maintain alignment of the rings 62 and 122 while rotating them, it is advantageous to provide the rings with tabs 140 which extend from inside the ring and beyond the serrations. In this way, the free ends of the tabs 140 remain inside the opposing ring even when the rings are far enough apart to separate the serrations and allow rotation of the rings.

To add yet another point of adjustment in the assembly 10, the first and second ends 82 and 84 of the second clamp 80 preferably are rotatable relative to each other about the longitudinal axis 86. To this end, as shown in FIG. 12, the second clamp 80 is formed into two members including a first end member 141 having a first outer tubular section 142 and a second end member 143 with an inner tubular section 144, the inner tubular section being telescopically and rotatably received inside the outer tubular section.

Figure 7:
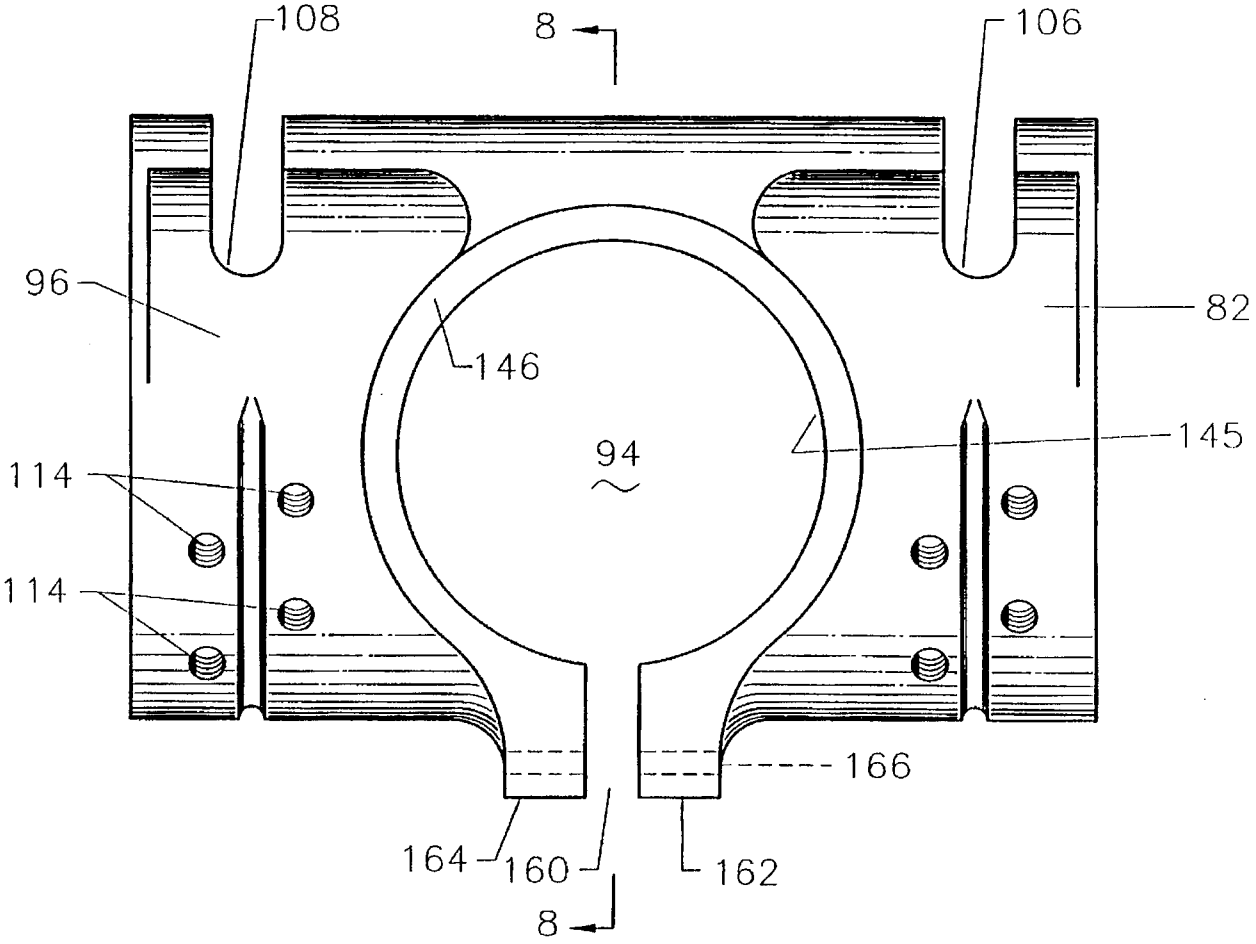
FIG. 7 is an elevational view of the second end of the first end member of the second clamp.
Figure 8:
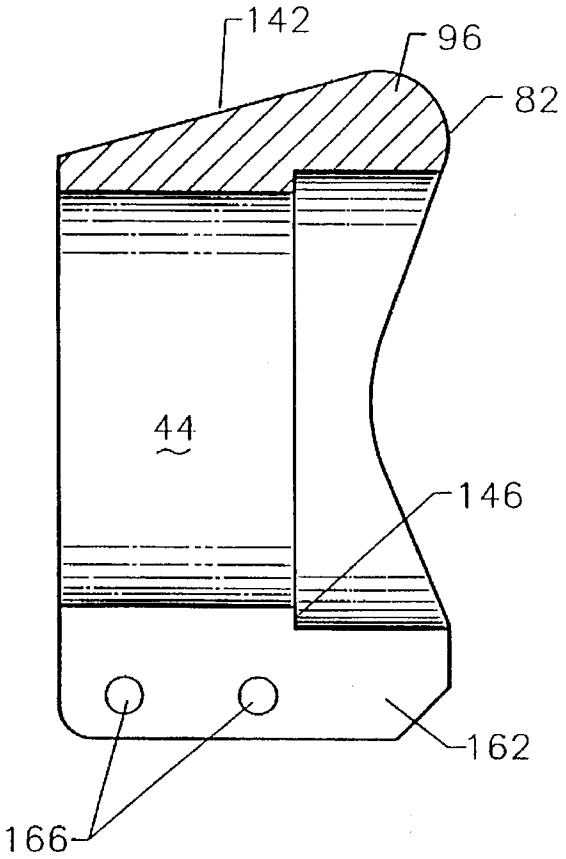
FIG. 8 is a longitudinal sectional view through the first end member of the second clamp taken along line 8—8 of FIG. 7.

As seen in FIGS. 7 and 8, a counterbore 145 is formed is formed inside the outer tubular section 142 to provide an annular shoulder 146. The end 148 of the inner tubular section 144 is provided with a circumferential groove 150 (FIGS. 9 and 12), and the length of the inner tubular section is such that the end 148 and the groove 150 extend just beyond the shoulder 146. The longitudinal position of the inner tubular section 144 with respect to the outer tubular section 142 is limited by a collar 152. A snap ring 156, sized to fit in the groove 150, is included. The ends of the snap ring 156 have apertured tabs (not shown) for connecting the ends during assembly of the clamp assembly 10. Thus, once the inner tubular section 144 is inserted into the outer tubular section 142, the snap ring 156 is connected for securing the inner tubular section 144 within the outer tubular section 142. The outer tubular section 142 of the first end member 141 has a longitudinal slot 160 formed by flanges 162 and 164 with bolt holes 166. Using nuts (not shown) and bolts 168, the rotational orientation of the inner tubular section 144 is fixed by tightening the outer tubular section. This inner and outer tubular arrangement is disclosed in more detail in U.S. Pat. No. 4,659,046, entitled "Traffic Control Device Mast Arm Bracket," issued Apr. 21, 1987, and the contents of this patent are incorporated herein by reference.

Now it will be appreciated that the clamp assembly 10 of this invention articulates at several points. The position of the anchor plate 96 on the mast arm can be rotated as well as moved longitudinally. Similarly, the position of the saddle 48 on the elongate member 22 of the traffic signal bracket 17 can be rotated and moved longitudinally. The face 120 of the second end 84 of the second clamp 80 is rotatable relative to the anchor plate 96, and the opposing serrated rings 62 and 122 can be rotated relative to each other.

Figure 13:
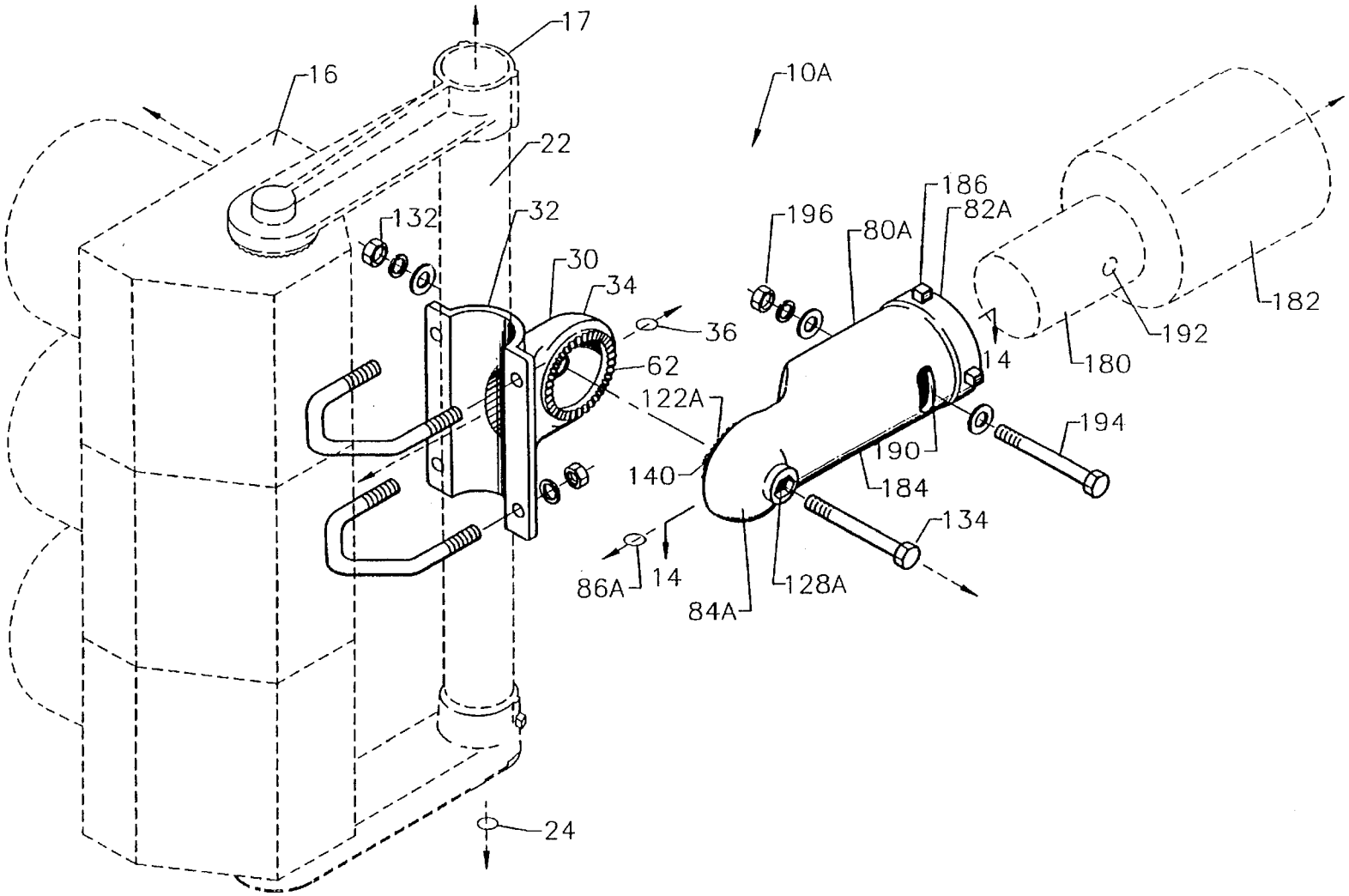
FIG. 13 is a right frontal perspective view of a second embodiment of the clamp assembly of the present invention. In this embodiment, the clamp assembly comprises a tenon clamp which supports the bracket of the traffic signal on the end or tenon of a mast arm. The mast arm, bracket and signal are shown in phantom to better illustrate the structure of the clamp assembly.
Figure 14:
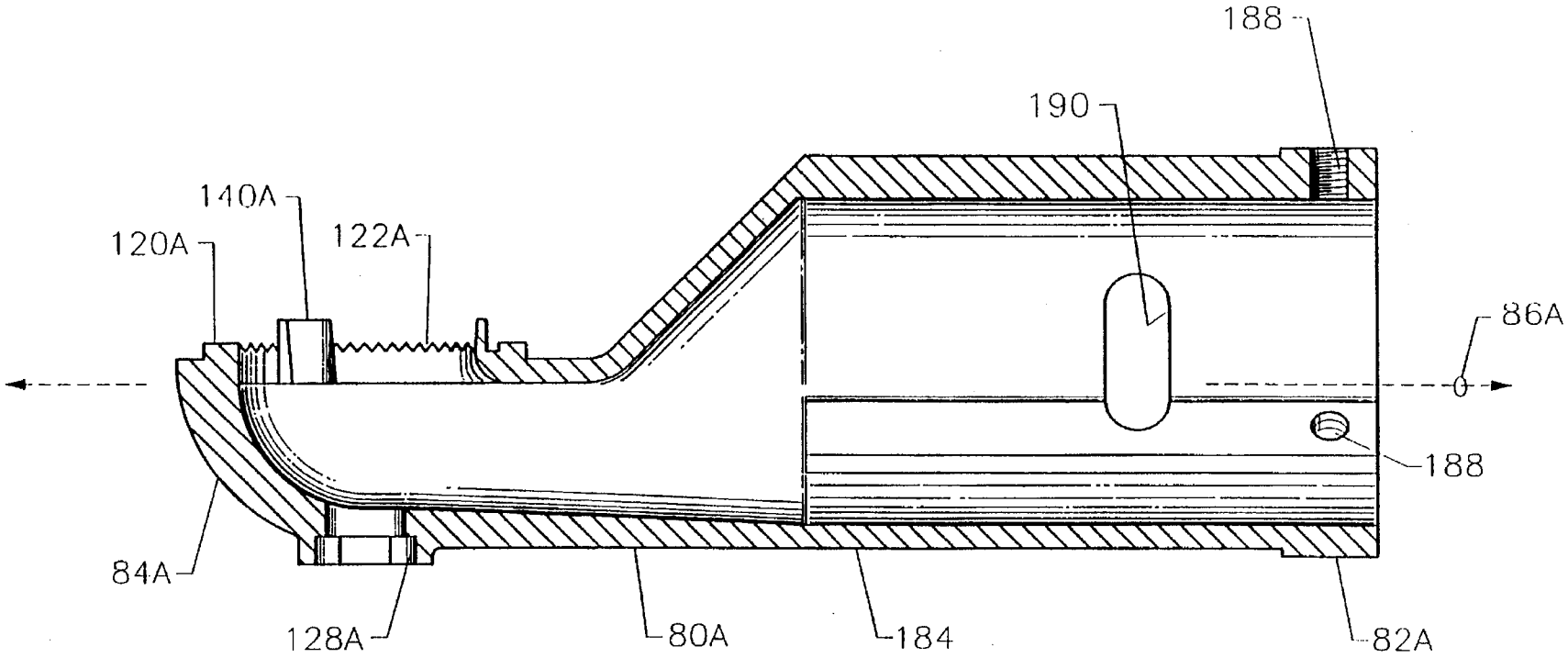
FIG. 14 is a longitudinal sectional view of the second clamp shown in FIG. 13 taken along line 14—14.

Attention now is directed to FIGS. 13 and 14 in which there is illustrated a second embodiment of the clamp assembly of the present invention designated generally by the reference numeral 10A. The clamp assembly 10A comprises a first clamp 30 with a first end 32 for attaching to the elongate member 22 of a traffic signal bracket 17 supporting a signal body 16. The first clamp 30 has a second end 34 with a serrated ring 62. The clamp assembly 10A further comprises a second clamp 80A having a second end 84A with a serrated ring 122A and tabs 140A, which engage the ring 62 on the second end 34 of the first clamp 30, and a bolt hole 128A for receiving the nut 132 and bolt 134, all in the manner described previously.

The first end 82A of the second clamp 80A, however, is modified so as to be mountable on the tenon end 180 of a mast arm 182 or other elongate support member. To that end, the first end 82A comprises an elongate tubular section 184. Preferably, the tubular section 184 is integrally formed with the first end 84A and is aligned with the longitudinal axis 86A of the second clamp 80A. The tubular section 184 is sized to be received on the tenon end 180 and is provided with set screws 186 receivable in threaded bores 188 spaced around the first end 82A to fix the longitudinal position and rotational orientation of the first end 82A on the mast arm 182.

To provide a more secure and permanent connection between the second clamp 80A and the tenon end 180 of the mast arm 182, the body of the second clamp 80A is provided with a connector assembly. A preferred connector assembly includes opposing slots 190 through which holes 192 in the tenon end 180 can be aligned. The holes 192 in the tenon end 180 typically are drilled during the assembly process once the second clamp 80A is properly positioned. Then this position is secured with a bolt 194 and a nut 196.

Thus, in accordance with this second embodiment, the clamp assembly 10A articulates at several different points providing versatility in the mounting arrangement of virtually any traffic control device on the tenon end of a mast arm. It will be noted that the second clamp of the first embodiment (FIG. 1) and the second clamp of the second embodiment (FIG. 13) can be made to be interchangeable with the first clamp which is similarly formed in both embodiements.

In use, the specific traffic control device to be mounted and the type of support member on which it is to be supported first are selected. Then, appropriate first and second clamp members with associated connector assemblies are provided. The manner of assembling the various components can vary, and these assembly methods will be apparent to those of ordinary skill in the art. For example, the second clamp may be attached first to the mast arm or support member first. Then, the wires can be fed through the internal channel. Next, the traffic control device, with the first clamp attached to the bracket, can be connected to the first clamp, and the wiring is extended to the traffic control device. Finally, the axes of alignment are adjusted as desired to position the traffic control device and all the hardware is secured.

Changes may be made in the combination and arrangement of the various parts, elements, steps and procedures described herein without departing from the spirit and scope of the invention as defined in the following claims.

What is claimed is:

1. A clamp assembly for supporting a traffic control device on an elongate support member, the clamp assembly comprising:

a first clamp having a first end and a second end, an opening in the first end, an opening in the second end, and an internal channel connecting the openings in the first and second ends;

a connecting assembly on the first end of the first clamp adapted to removably attach the first end of the first clamp member to the traffic control device;

a second clamp having a first end, a second end and a longitudinal axis, and further having an opening in the first end, an opening in the second end, and an internal channel connecting the openings in the first and second ends, and wherein the first end is rotatable on the longitudinal axis relative to the second end;

a connecting assembly on the first end of the second clamp adapted to removably attach the first end of the second clamp to the elongate support member so that the second clamp extends generally perpendicular to the elongate support member and so that the second clamp can be attached to the elongate support member in a plurality of positions along the length of the elongate support member and in a plurality of positions about the circumference of the elongate support member;

a first serrated ring on the second end of the first clamp;

a second serrated ring on the second end of the second clamp, wherein the second serrated ring is adapted to removably mate with the first serrated ring in a plurality of selected positions and so that the openings in the second ends of the first and second clamps are aligned to connect the internal channels when the first and second serrated rings are interengaged; and a connector assembly for rigidly connecting the second end of the first clamp member to the second end of the second clamp member when the first and second serrated rings are interengaged in a selected position.

2. The clamp assembly of claim 1 wherein the second clamp comprises:

a first tubular section extending from the first end;

a second tubular section extending from the second end, the second tubular section being received rotatably within the first tubular section; and a connector assembly adapted to rigidly secure the first and second tubular sections together.

3. The clamp assembly of claim 2 wherein the connector assembly for attaching the first end of the second clamp to the elongate support member comprises:

an anchor plate formed on the first end and shaped to conform to the side of the elongate support member; and a connector for attaching the anchor plate to the elongate support member.

4. The clamp assembly of claim 3 wherein the connector comprises a flexible, adjustable cable which encircles the elongate support member.

5. The clamp assembly of claim 1 wherein the traffic control device includes a bracket having an elongate member, and wherein the connector assembly on the first end of the first clamp is adapted to attach the first clamp generally perpendicular to the elongate member of the bracket of the traffic control device whereby the first clamp can be positioned in a plurality of locations along the length of the elongate member.

6. The clamp assembly of claim 5 wherein the connector assembly on the first end of the first clamp comprises:

a saddle plate shaped to conform to the side of the elongate member of the traffic signal bracket; and a connector adapted to connect the saddle plate to the elongate member of the bracket of the traffic control device.

7. The clamp assembly of claim 6 wherein the connector comprises a pair of U-bolts sized to receive the elongate member of the bracket of the traffic control device.

8. The clamp assembly of claim 1 wherein the first serrated ring defines a plane parallel to the longitudinal axis of the first clamp, and wherein the second serrated ting defines a plane parallel to the longitudinal axis of the second clamp so that the first clamp is pivotally adjustable relative to the second clamp.

9. A clamp assembly for supporting a traffic control device on an elongate support member with an end wherein the traffic control device comprises a bracket having an elongate member, the clamp assembly comprising:

a first clamp having a first end and a second end, an opening in the first end, an opening in the second end, and an internal channel connecting the openings in the first and second ends;

a connecting assembly on the first end of the first clamp adapted to removably attach the first end of the first clamp member to the traffic control device so that the first clamp is perpendicular to the elongate member of the bracket of the traffic control device and so that the first clamp can be attached in a plurality of positions along the length of the elongate member and in a plurality of positions about the circumference of the elongate member;

a second clamp having a first end, a second end, an opening in the first end, an opening in the second end, and an internal channel connecting the openings in the first and second ends, a connecting assembly on the first end of the second clamp adapted to removably attach the first end of the second clamp to the end of the elongate support member so that the second clamp and the support member are axially aligned;

a first serrated ring on the second end of the first clamp;

a second serrated ring on the second end of the second clamp, wherein the second serrated ring is adapted to removably mate with the first serrated ring in a plurality of selected positions and so that the openings in the second ends of the first and second clamps are aligned to connect the internal channels when the first and second serrated rings are interengaged; and a connector assembly for rigidly connecting the second end of the first clamp member to the second end of the second clamp member when the first and second serrated rings are interengaged in a selected position.

10. The clamp assembly of claim 9 wherein the second clamp comprises a tubular body, wherein the first end of the second clamp defines a cylindrical mouth extending from the tubular body, and wherein the cylindrical mouth is shaped to telescopically receive the end of the elongate support member.

11. The clamp assembly of claim 10 wherein the tubular body and the first and second ends of the second clamp all are integrally formed.

12. The clamp assembly of claim 9 wherein the first end of the first clamp comprises:

a saddle plate shaped to conform to the elongate member of the bracket of the traffic control device; and a connector adapted to connect the saddle plate to the elongate member.

13. The clamp assembly of claim 12 wherein the connector comprises a pair of U-bolts sized to receive the elongate member of the bracket of the traffic control device.

14. The clamp assembly of claim 9 wherein the first serrated ring defines a plane parallel to the longitudinal axis of the first clamp, and wherein the second serrated ring defines a plane parallel to the longitudinal axis of the second clamp so that the first clamp is pivotally adjustable relative to the second clamp.

* * * * *